US008714092B2

(12) United States Patent
Heitzenrater

(10) Patent No.: US 8,714,092 B2
(45) Date of Patent: May 6, 2014

(54) PIVOT SWITCH SYSTEM AND METHOD

(75) Inventor: Douglas Vincent Heitzenrater, McKees Rocks, PA (US)

(73) Assignee: Bombardier Transportation GmbH, Berlin (DE)

( * ) Notice: Subject to any disclaimer, the term of this patent is extended or adjusted under 35 U.S.C. 154(b) by 174 days.

(21) Appl. No.: 13/365,538

(22) Filed: Feb. 3, 2012

(65) Prior Publication Data

US 2013/0199404 A1 Aug. 8, 2013

(51) Int. Cl.
*E01B 25/28* (2006.01)
*E01B 7/04* (2006.01)
*E01B 7/08* (2006.01)

(52) U.S. Cl.
USPC ..... 104/130.09

(58) Field of Classification Search
USPC ..... 104/130.01, 130.03, 130.06, 130.09
See application file for complete search history.

(56) References Cited

U.S. PATENT DOCUMENTS

| | | | | |
|---|---|---|---|---|
| 3,073,259 | A * | 1/1963 | Peterson, Jr. et al. | 104/104 |
| 3,081,710 | A * | 3/1963 | Dehne | 104/130.09 |
| 3,093,090 | A * | 6/1963 | Rosenbaum | 104/130.11 |
| 3,785,294 | A * | 1/1974 | Omar | 104/130.01 |
| 4,870,906 | A * | 10/1989 | Schaffer et al. | 104/130.03 |
| 5,287,811 | A * | 2/1994 | Matsuura et al. | 104/130.03 |
| 5,410,969 | A | 5/1995 | Senes et al. | |
| 6,279,484 | B1 * | 8/2001 | Shaw | 104/130.01 |
| 8,430,038 | B2 * | 4/2013 | Fichtner et al. | 104/130.03 |

* cited by examiner

*Primary Examiner* — Zachary Kuhfuss
(74) *Attorney, Agent, or Firm* — The Webb Law Firm

(57) ABSTRACT

A switch system for a guided automatic transit vehicle (GATV) is adapted for maintaining a first path of travel or for redirecting the first path of travel of the GATV. The switch includes a continuous guide having a first end and a pivotable second end opposite the first end. The continuous guide has a first edge with a first edge profile and a first continuous sidewall and a second edge with a second edge profile and a second continuous sidewall. A pivot point having a pivot axis is provided at the pivotable second end. The switch system pivots about the pivot point from a first position and a second position. In the first position, the switch system maintains the GATV along the first path of travel via the first continuous sidewall. In the second position, the GATV travels along a second path via the second continuous sidewall.

24 Claims, 7 Drawing Sheets

PIVOT SWITCH SYSTEM AND METHOD

BACKGROUND OF THE INVENTION

1. Field of the Invention

This invention relates, in general, to a switch system for a guided automatic transit vehicle (GATV) and, more particularly, to a switch system adapted for either maintaining a first path of travel of the GATV or for redirecting the first path of travel of the GATV.

2. Description of the Related Art

Certain modern transit vehicles of the GATV type run along guideways having a substantially flat support surface and a central trough portion. These vehicles are guided by a steering mechanism that is disposed within the central trough portion such that the GATV is guided along the guideway by following the path of the central trough portion. While GATVs offer many advantages over other transportation systems, a number of disadvantages is also associated with such vehicles.

One of the major shortcomings of GATVs is their inability to quickly and effectively maintain or alter the path of travel over a switch point where a single guideway branches into or from multiple guideways. Existing switching mechanisms often include complicated assemblies that are expensive to manufacture and difficult to install. Due to their complex design, existing switching mechanisms require regular maintenance, which typically requires the guideway to be shut down. Many prior art switching mechanisms also require a significant reduction in speed of the GATV while it travels across the switch point. In cold climates, snow and ice can often accumulate and jam the switching mechanism, often rendering the switch point inoperable.

While various attempts have been made to overcome this shortcoming, none of the existing switch systems has successfully overcome these problems. In view of the foregoing, a need exists for a switch system having a simple construction that can be easily installed on an existing or new guideway for GATVs. Furthermore, an additional need exists to provide a switch system that is economical to manufacture and utilizes easily replaceable and serviceable parts. A further need exists for a switch system that efficiently maintains the existing travel path or redirects the travel path of the GATV without any appreciable reduction in speed.

SUMMARY OF THE INVENTION

As described in detail herein, a switch system is provided for a GATV running along a guideway that desirably has a flat running surface with a central trough portion having a first edge and a second edge. The switch system may be adapted for either maintaining a first path of travel of the GATV or for redirecting the first path of travel of the GATV to a second path of travel.

According to one embodiment, the switch system may include a continuous guide having a first end and a pivotable second end opposite the first end. The guide may further include a first edge having a first edge profile and a second edge having a second edge profile. In this manner, a first continuous sidewall may extend along the first edge between the first and the second end of the continuous guide. Similarly, a second continuous sidewall may extend along the second edge between the first and the second end of the continuous guide. In one embodiment, the first sidewall is linear and the second sidewall is curvilinear. The second sidewall may have a curvature of constant or varying radius. In another embodiment, both the first and second sidewalls may be curvilinear.

As will be described in greater detail below, the switch system may be provided with a pivot point about the pivotable second end. The pivot point desirably has a pivot axis transverse to the longitudinal axis of the continuous guide. The pivot point may include a thrust bearing for supporting a vertical load on the switch system. In operation, the switch system may pivot about the pivot point from an initial first position and a final second position.

In the initial first position, the switch system desirably allows the GATV to continue travel along the first path of travel via the first continuous sidewall. In this configuration, the first continuous sidewall may be aligned with the second edge of the central trough portion. In the final second position, the switch system desirably allows the GATV to travel along a second path of travel via the second continuous sidewall. In this configuration, the second continuous sidewall is aligned with the first edge of the central trough portion.

In accordance with another embodiment, the pivot switch may include at least one rolling support member at the first end. The rolling support member desirably allows for selective pivotal movement of the continuous guide about the pivot point between an initial first position and the final second position. The rolling support member may be a caster wheel or a cylindrical roller.

According to another embodiment, the switch system may further include a stop member for selectively limiting the pivotal movement of the continuous guide between the initial first position and the final second position. Additionally, a power member may be provided for selective pivotal movement of the continuous guide between the initial first position and the final second position. The power member may be a mechanical, electrical, hydraulic, pneumatic, or magnetic device. In another embodiment, a controller may be operatively coupled with the switch system for controlling the selective pivotal movement of the continuous guide between the initial first position and the final second position. The controller may also control the operation of the stop member and the power member.

According to a further embodiment, a method of switching a travel path of a guided automatic transit vehicle (GATV) is provided. The method may include the steps of providing a guideway having a flat running surface and providing the switch system on the guideway. The guideway desirably has a central trough portion with a first edge and a second edge. The method may further include the steps of guiding the GATV on the guideway along a first path of travel and selectively pivoting the switch system between the initial first position and the final second position. In the initial first position, the switch system desirably allows the GATV to continue travel along the first path of travel via the first continuous sidewall. In this configuration, the first continuous sidewall may be aligned with the second edge of the central trough portion. In the final second position, the switch system desirably allows the GATV to travel along a second path of travel via the second continuous sidewall. In this configuration, the second continuous sidewall is aligned with the first edge of the central trough portion.

The switch system for use with the method of switching a travel path of the GATV may include a continuous guide having a first end and a pivotable second end opposite the first end. The guide may further include a first edge having a first edge profile and a second edge having a second edge profile. In this manner, a first continuous sidewall may extend along the first edge between the first and the second end of the continuous guide. Similarly, a second continuous sidewall may extend along the second edge between the first and the second end of the continuous guide. In one embodiment, the first sidewall is linear and the second sidewall is curvilinear. The second sidewall may have a curvature of constant or varying radius. In another embodiment, both the first and second sidewalls may be curvilinear. The switch system may be provided with a pivot point about the pivotable second end. The pivot point desirably has a pivot axis transverse to the longitudinal axis of the continuous guide. The pivot point may include a thrust bearing for supporting a vertical load on the switch system. In operation, the switch system may pivot about the pivot point from the initial first position and the final second position.

The method of switching a travel path of the GATV may further include the step of providing at least one rolling support member at the first end for selective pivotal movement of the continuous guide about the pivot point between the initial first position and the final second position. The rolling support member desirably allows for selective pivotal movement of the continuous guide about the pivot point between an initial first position and the final second position. The rolling support member may be a caster wheel or a cylindrical roller.

The method may additionally include the step of providing a stop member for selectively limiting the pivotal movement of the continuous guide between the initial first position and the final second position. A power member may be provided for selective pivotal movement of the continuous guide between the initial first position and the final second position. The power member may be a mechanical, electrical, hydraulic, pneumatic, or magnetic device. In another embodiment, the method of switching a travel path of the GATV may further include the step of providing a controller to regulate the operation of the switch system. The controller is operatively coupled with the switch system for controlling the selective pivotal movement of the continuous guide between the initial first position and the final second position.

Further details and advantages of the present invention will become apparent from the following detailed description read in conjunction with the drawings.

DETAILED DESCRIPTION OF THE INVENTION

Figure 1:
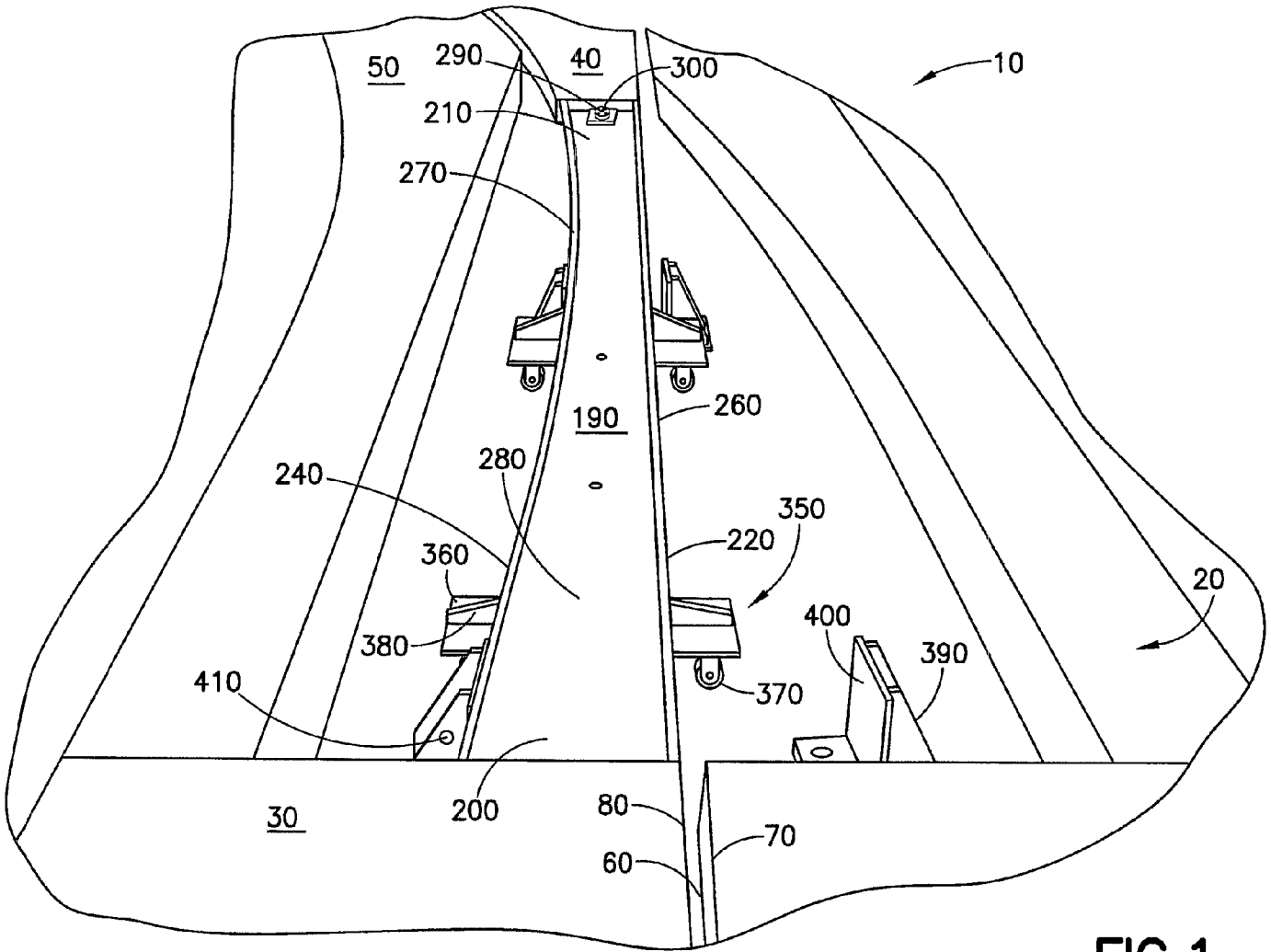
FIG. 1 is a perspective view of one embodiment of a switch system showing a continuous guide in an initial first position.

For purposes of the description hereinafter, spatial orientation terms, as used, shall relate to the referenced embodiment as it is oriented in the accompanying drawing figures or otherwise described in the following detailed description. However, it is to be understood that the embodiments described hereinafter may assume many alternative variations and configurations. It is also to be understood that the specific components, devices, and features illustrated in the accompanying drawing figures and described herein are simply exemplary and should not be considered as limiting.

Referring to the drawings in which like reference characters refer to like parts throughout the several views thereof, an embodiment of a switch system for a GATV is shown and is generally described hereinafter for use in maintaining a first path of travel of the GATV or for redirecting the first path of travel of the GATV.

Figure 2:
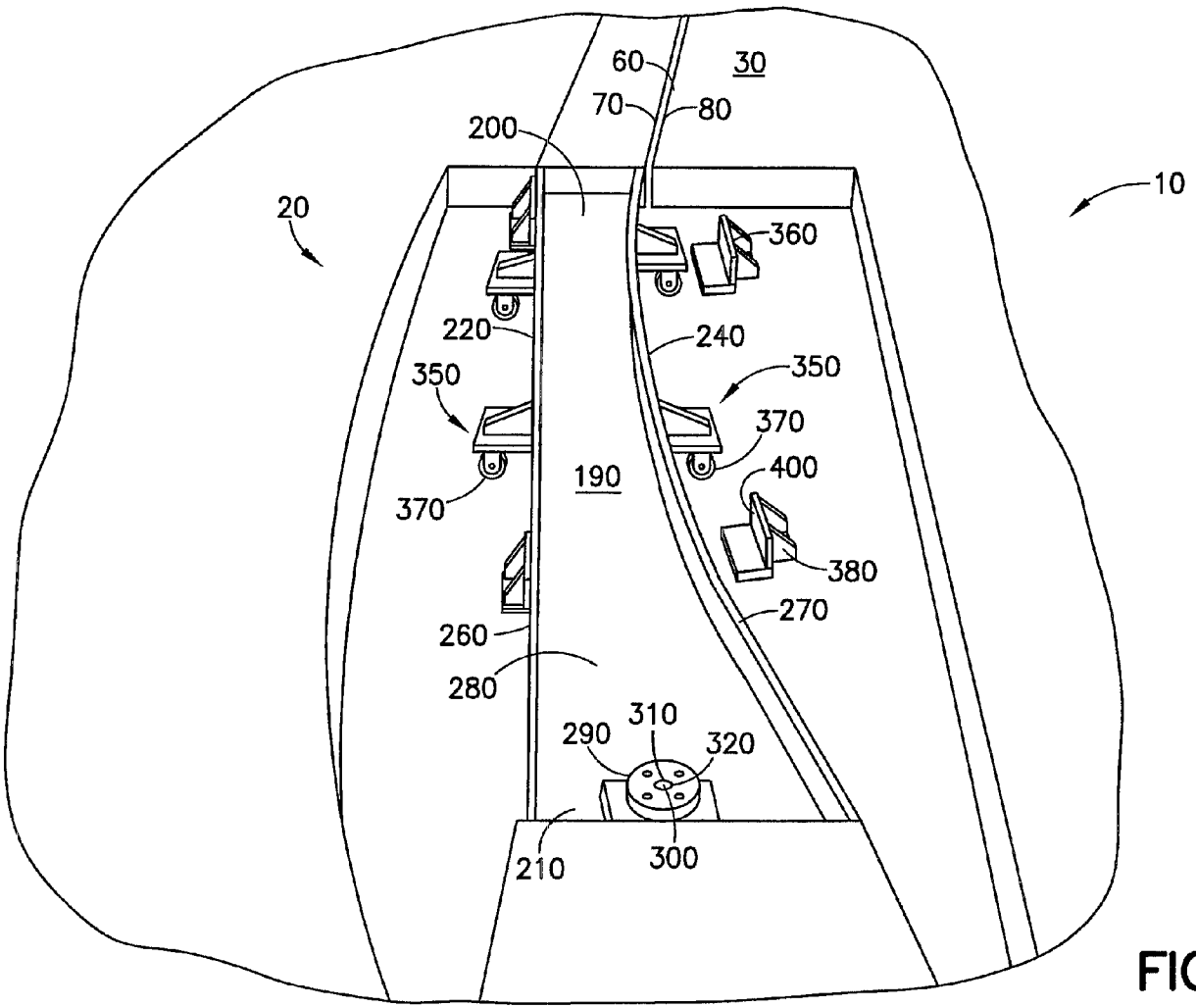
FIG. 2 is a perspective view of the switch system showing the continuous guide in a final second position.

With reference to FIGS. 1 and 2, a switch system 10 is provided at a switch point on a guideway 20, where a first guideway section 30 branches into a second guideway section 40 and a third guideway section 50. The switch system 10 is adapted for maintaining a first path of travel of the GATV (not shown in FIGS. 1 and 2) between first guideway section 30 and second guideway section 40, or redirecting the GATV to a second path of travel between first guideway section 30 and third guideway section 50. Guideway 20 includes a substantially flat running surface with a central trough portion 60 having a first edge 70 and a second edge 80. The GATV is supported on the flat running surface of guideway 20 and guided along central trough portion 60.

Figure 3:
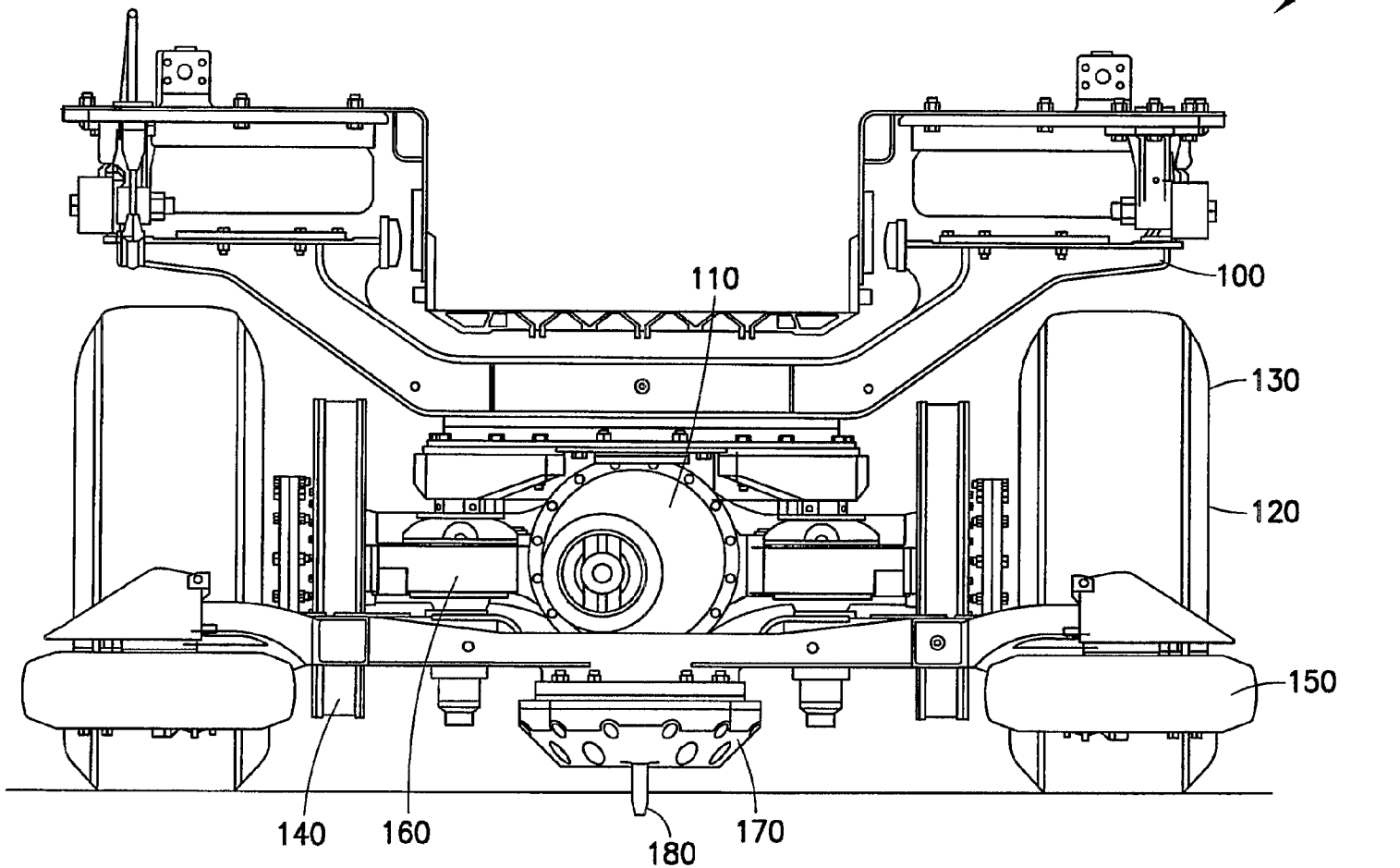
FIG. 3 is a perspective front view of a GATV.

With reference to FIG. 3, GATV 90 includes a chassis 100 having a plurality of bogeys 110 fitted thereon. In the embodiment illustrated in FIG. 3, bogeys 110 are provided at front and rear ends of chassis 100 along the longitudinal length of chassis 100. Each bogey 110 is fitted with wheels 120 having pneumatic tires 130 that run on guideway 20. Each bogey 110 is independently rotatable with respect to chassis 100 to allow GATV 90 to turn along the curved sections of guideway 20. A braking mechanism 140 is provided to brake each wheel 120. Chassis 100 also includes a power supply mechanism 150 to supply electrical power to one or more drive motors 160. The power supply mechanism 150 is desirably located along the longitudinal side of chassis 100 such that it may be operatively coupled to an electrical line (not shown) provided on the side of guideway 20. Although FIG. 3 illustrates chassis 100 fitted with two bogeys 110, with each bogey 110 having two wheels 120 mounted thereon, it will be apparent to one of ordinary skill in the art that additional bogeys 110 may be provided and that each bogey 110 may have more than one wheel and tire mounted thereon. A cabin (not shown) is provided on chassis 100.

With continuing reference to FIG. 3, bogey 110 provided at a front end of chassis 100 includes a steering device 170 for guiding GATV 90 along guideway 20. Steering device 170 includes a steering caster 180 which is oriented substantially perpendicular to guideway 20. Steering caster 180 is capable of rotating about its own axis. Furthermore, steering caster 180 is capable of making small amplitude movements about an axis passing through the center of steering caster 180. Steering caster 180 is in a fixed orientation with respect to bogey 110 such that movement of steering caster device 180 in the longitudinal direction of chassis 100 or in the direction perpendicular to the plane of guideway 20 is prevented.

Steering caster 180 is dimensioned to engage central trough portion 60 of guideway 20 (shown in FIGS. 1 and 2). While steering caster 180 is generally not needed for travel in a linear direction, it is necessary for guiding GATV 90 along curved sections of guideway 20 or when changing a path of travel of GATV 90 at a switch point. When a change in the travel path of GATV 90 is desired, such as when GATV 90 travels along curved sections of guideway 20, steering caster 180 contacts one of first edge 70 or second edge 80 of central trough portion 60 and thereby constrains the motion of GATV 90 to follow the path of central trough portion 60. For example, when guideway 20 transitions from a linear section to a section that curves in a first direction, such as to the left, steering caster 180 contacts first edge 70 of central trough portion 60 to constrain GATV 90 to follow the path of central trough portion 60. Similarly, when guideway 20 transitions from a linear section to a section that curves in a second direction, such as to the right, steering caster 180 contacts second edge 80 of central trough portion 60 to constrain GATV 90 to follow the path of central trough portion 60.

Referring back to FIGS. 1 and 2, switch system 10 is adapted for guiding GATV 90 along a switch point where first guideway section 30 branches into a second guideway section 40 and third guideway section 50. Switch system 10 interacts with steering caster 180 of GATV 90 in a manner that will be described in greater detail hereafter. Switch system 10 includes a continuous guide 190 having a first end 200 and a pivotable second end 210 opposite first end 200. Continuous guide 190 is provided in a transition area between first guideway section 30, a second guideway section 40, and third guideway section 50.

Figure 4:
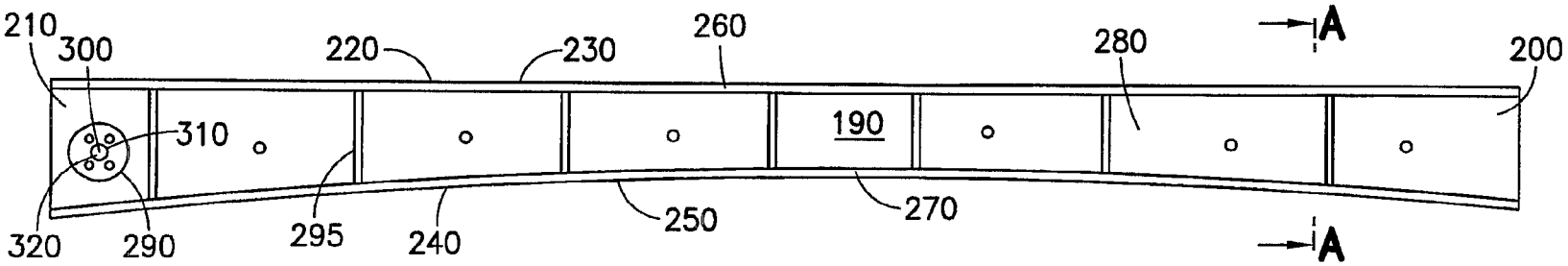
FIG. 4 is a top view of the continuous guide shown in FIGS. 1 and 2.
Figure 5:
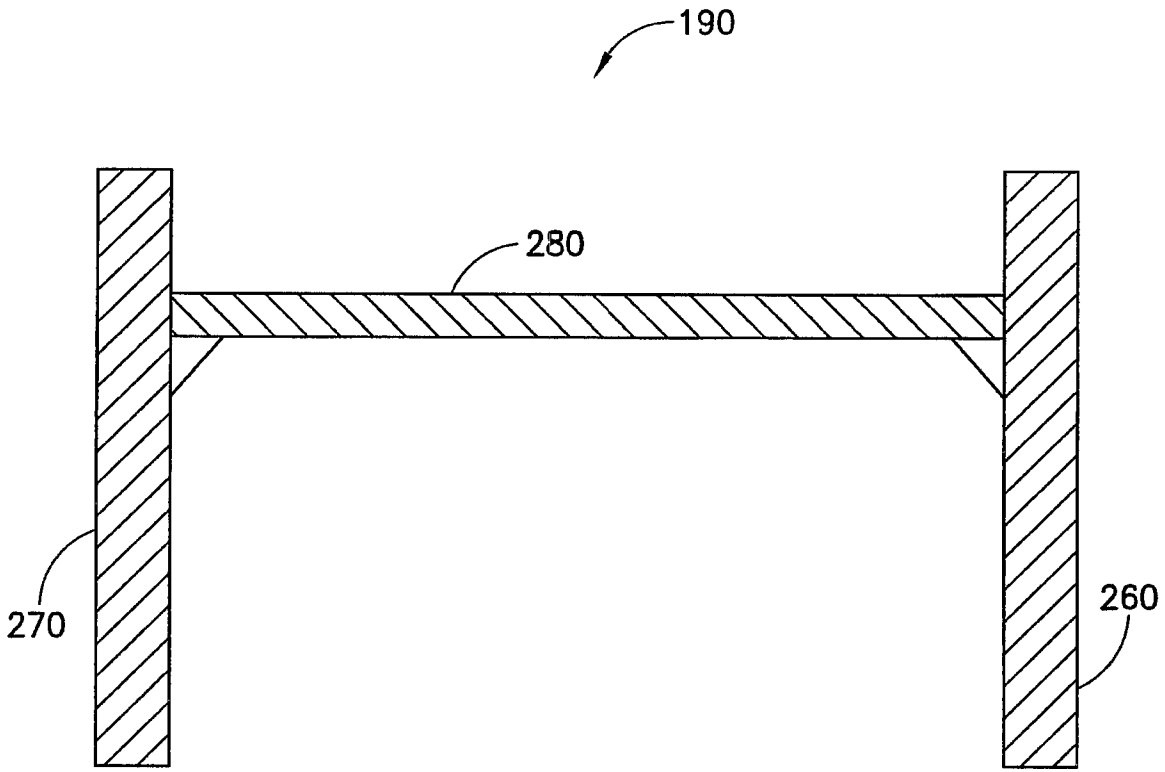
FIG. 5 is a cross-sectional view of the continuous guide shown in FIG. 4 taken along line A-A.

With reference to FIGS. 4 and 5, and with continuing reference to FIGS. 1 and 2, continuous guideway 190 is an elongated member having a first guide edge 220 with a first edge profile 230 and a second guide edge 240 with a second edge profile 250. A first continuous sidewall 260 runs along first guide edge 220 between first end 200 and second end 210 of continuous guide 190. Similarly, a second continuous sidewall 270 runs along second guide edge 240 between first end 200 and second end 210 of continuous guide 190. In the embodiment illustrated in FIGS. 1-2 and 4-5, first continuous sidewall 260 is linear while second continuous sidewall 270 is curvilinear. One of ordinary skill in the art will understand that this embodiment is exemplary only, and that one or both of first continuous sidewall 260 and second continuous sidewall 270 may have an alternate shape. For example, both first continuous sidewall 260 and second continuous sidewall 270 may be curvilinear. A radius of curvature for one or both of first continuous sidewall 260 and second continuous sidewall 270 may be constant or variable along their length.

With reference to FIG. 5, a cross section of continuous guide 190 taken along line A-A is illustrated. First continuous sidewall 260 and second continuous sidewall 270 are oriented in a substantially vertical direction and are separated by an elongated member 280. Elongated member 280 may be welded to each of first continuous sidewall 260 and second continuous sidewall 270 such that elongated member 280 is oriented in a substantially perpendicular direction to each of first continuous sidewall 260 and second continuous sidewall 270. In one exemplary embodiment, elongated member 280, first continuous sidewall 260, and second continuous sidewall 270 are constructed from commercially available plate steel that is cut to have a desired shape specified for switch system 10.

Referring back to FIG. 4, pivotable second end 210 of continuous guide 190 includes a pivot point 290 having a pivot axis 300 oriented in a transverse direction to the longitudinal axis of continuous guide 190. An aperture 310 extends through the thickness of elongated member 280 at pivot point 290. A bolt 320 is inserted through aperture 310 to secure continuous guide 190 to pivot bearing support 330 (shown in FIG. 6) and allows continuous guide 190 to rotate about bolt 320 between an initial first position and the final second position.

Figure 6:
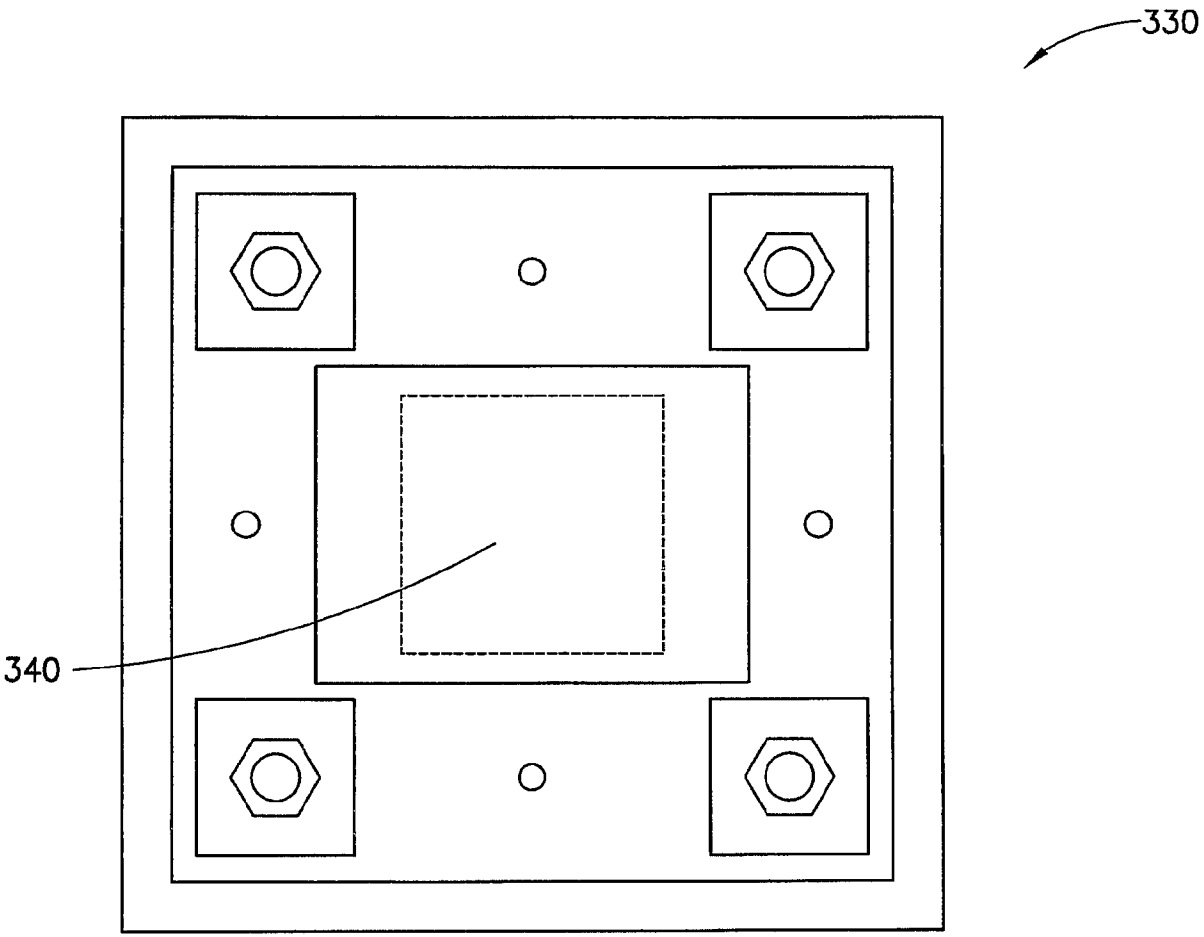
FIG. 6 is a top view of a pivot bearing support.

With reference to FIG. 6, pivot bearing support 330 is secured to the ground via a plurality of bolts. A pivot bearing 340 supports the weight of continuous guide 190 at pivotable second end 210 and enables rotation of continuous guide 190 about pivotable second end 210 between an initial first position and the final second position. Pivot bearing 340 may be a thrust bearing. Alternatively, pivot bearing 340 may have a simpler construction and include only a grease plate.

Referring back to FIGS. 1-2, continuous guide 190 further includes a rolling support member 350 at first end 200. Rolling support member 350 supports the weight of continuous guide 190 at first end 200 and enables first end 200 to pivot between an initial first position and the final second position. Continuous guide 190 is illustrated in the initial first position in FIG. 1 to allow GATV 90 to maintain a first travel path from first guideway section 30 to second guideway section 40. When pivotable second end 210 of continuous guide 190 is pivoted about pivot axis 300 such that rolling support member 350 pivots continuous guide 190 from initial first position to final second position illustrated in FIG. 2, the travel path of GATV 90 is redirected to go from first guideway section 30 to third guideway section 50.

Rolling support member 350 includes a beam 360 secured to continuous guide 190 along the bottom part thereof. A pair of wheels 370 extends vertically downward from the beam to contact the ground and enable rolling support of first end 200 of continuous guide 190. Wheels 370 are desirably caster wheels capable of rotating about vertical and horizontal axes of the wheels. A pair of fixing plates 380 secures beam 360 to a portion of first continuous sidewall 260 and second continuous sidewall 270. A plurality of rolling support members 350 may be provided along the longitudinal length of continuous guide 190 to better support the weight of continuous guide 190 and increase its load bearing capacity.

While rolling support member 350 illustrated in FIGS. 1 and 2 is a mechanical device, one of ordinary skill in the art will understand that rolling support member 350 may be easily adapted to include propulsion means to move rolling support member 350 via mechanical, electrical, hydraulic, pneumatic, or magnetic means. Discussion of these alternate embodiments will follow hereafter.

With continuing reference to FIGS. 1 and 2, a stop member 390 is provided adjacent to rolling support member 350. Stop member 390 includes two stop faces 400 which limit the pivoting movement of first end 200 between an initial first position and the final second position. Continuous guide 190 is illustrated in the initial first position in FIG. 1 with stop member 380 limiting the pivoting movement of first end 200 of continuous guide 190 to align first continuous sidewall 260 with second edge 80 of central trough portion 60 of first guideway section 30 and second edge 80 of central trough portion 60 of second guideway section 40. When pivotable second end 210 of continuous guide 190 is pivoted about pivot axis 300 such that rolling support member 350 pivots continuous guide 190 from initial first position to final second position illustrated in FIG. 2, stop member 380 limits pivoting movement of first end 200 of continuous guide 190 to final second position. In this manner, second continuous sidewall 270 is aligned with first edge 70 of central trough portion 60 of first guideway section 30 and first edge 70 of central trough portion 60 of third guideway section 50 to redirect the travel path of GATV 90 from first guideway section 30 to third guideway section 50.

One stop face 400 of stop member 390 is oriented substantially parallel with first continuous sidewall 260 while the other stop face 400 is oriented substantially parallel with second continuous sidewall 270. In this manner, stop face 400 that is adjacent to first continuous sidewall 260 abuts against first continuous sidewall 260 when first end 200 of continuous guide 190 is pivoted to the final second position. Similarly, stop face 400 that is adjacent to second continuous sidewall 270 abuts against second continuous sidewall 270 when first end 200 of continuous guide 190 is pivoted to the initial first position.

A locking mechanism 410 may be provided at first end 200 or second end 210 of continuous guide 190 for locking continuous guide 190 in the initial first position or the final second position. Locking mechanism 410 may be provided on stop member 390 or as a separate structure. While locking mechanism 410 illustrated in FIGS. 1 and 2 is a mechanical device, one of ordinary skill in the art will understand that locking mechanism 410 may be easily adapted to include mechanical, electrical, hydraulic, pneumatic, or magnetic means. Discussion of these alternate embodiments will follow hereafter.

As shown in FIG. 4, a plurality of stiffener plates 295 may be provided along the length of elongated member 280 to increase the lateral stiffness of continuous guide 190. Stiffener plates 295 are desirably welded in a channel portion defined between first continuous sidewall 260, second continuous sidewall 270, and elongated member 280. Additionally, a plurality of drainage holes 305 are provided on elongated member 280 to drain water that may accumulate on the surface of elongated member 280. Drainage holes 305 extend through the thickness of elongated member 280.

Figure 7:
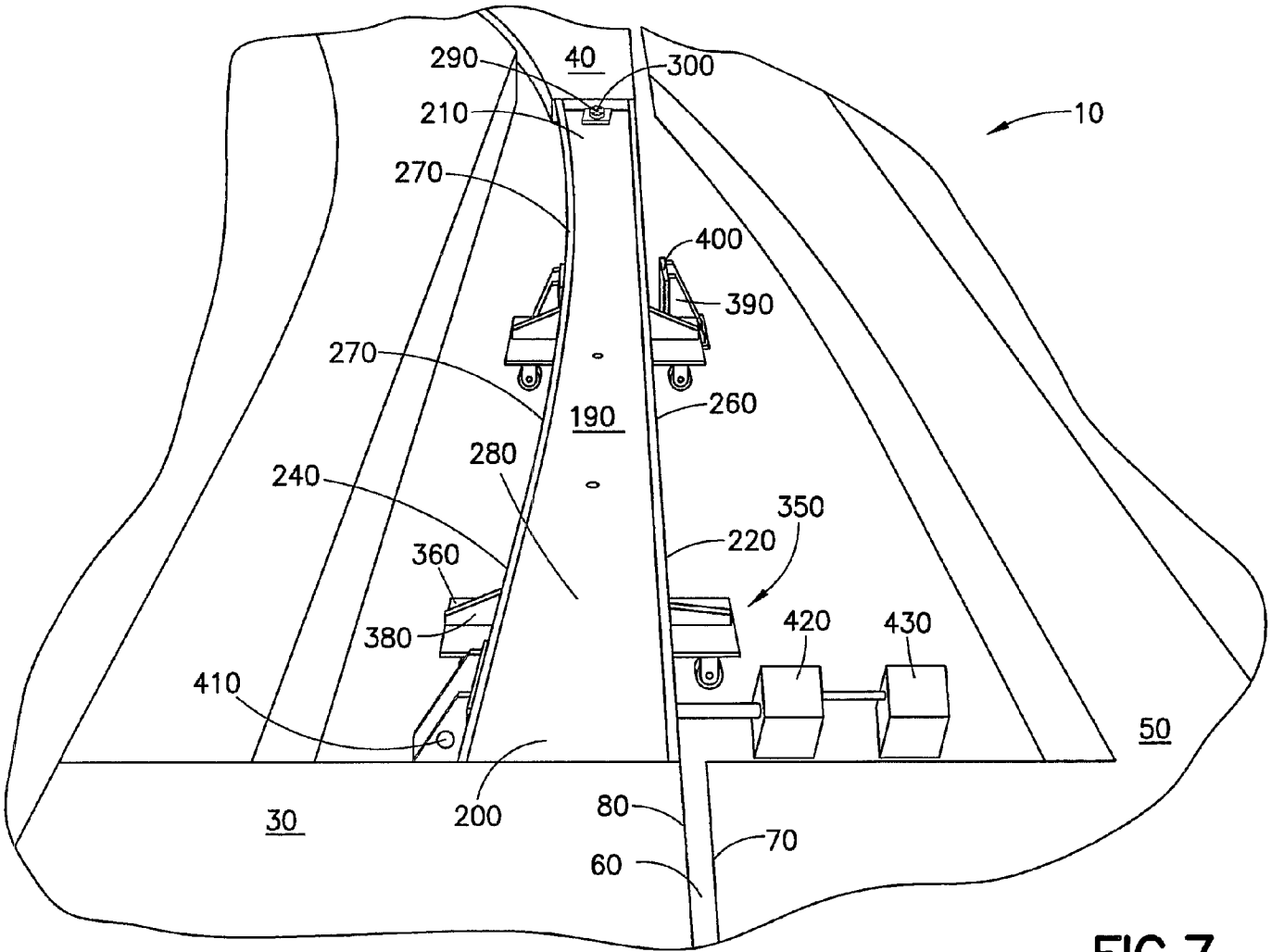
FIG. 7 is a perspective view of another embodiment of a switch system showing a controller.

With reference to FIG. 7, an alternate embodiment of switch system 10 is illustrated. In this embodiment, the structure and function of all elements of continuous guide 190 are substantially identical to the structure and function of elements of continuous guide 190 described above. The embodiment of switch system 10 illustrated in FIG. 7 includes a power member 420 for selective pivotal movement of first end 200 of continuous guide 190 between the initial first position and the final second position. Power member 420 may be a mechanical, electrical, hydraulic, pneumatic, or magnetic device which selectively urges continuous guide 190 to move between the initial first position and the final second position. Power member 420 may be associated with rolling support member 350. In a non-limiting example, power member 420 may be a hydraulic rod (not shown).

With continuing reference to FIG. 7, switch system 10 further includes a controller 430 for controlling the selective pivotal movement of continuous guide 190 between the initial first position and the final second position. Controller 430 desirably includes a microprocessor device having memory storage with a plurality of stored commands to control the operation of switch system 10. For example, controller 430 may be programmed to activate switch system 10 to move from the initial first position to the final second position in response to a signal sent by an approaching GATV 90. Alternatively, controller 430 may be programmed to activate switch system 10 to move from the initial first position to the final second position according to a pre-determined running schedule for GATV 90. Controller 430 desirably controls the operation of power member 420 as well as any other device capable of automated control. In some embodiments, controller 430 may be controlled remotely, such as via wireless communication. Controller 430 desirably has a manual override to control switch system 10 independently of the pre-programmed controls.

Having described switch system 10 in detail with reference to FIGS. 1-7, a method switching a travel path of GATV 90 will now be described. As noted above, GATV 90 runs along guideway 20 having a flat running surface with a central trough portion 60 having first edge 70 and second edge 80. Steering caster 180 of GATV 90 extends into central trough portion 60 of guideway 20 and can selectively engage one of first edge 70 or second edge 80 to maintain GATV traveling in the direction of central trough portion 60. When a change in the travel path of GATV 90 is desired, such as when GATV 90 travels along curved sections of guideway 20, steering caster 180 contacts one of first edge 70 or second edge 80 of central trough portion 60 as central trough portion 60 begins to curve and thereby constrains the motion of GATV 90 to follow the path of central trough portion 60.

Switch system 10 is provided at a switch point along guideway 20 where first guideway section 30 branches into second guideway section 40 and third guideway section 50. Switch system 10 is disposed between first guideway section 30 and second and third guideway sections, such that a gap is created between central trough portion 60 of first guideway section 30 and central trough portion 60 of second and third guideway sections. Because GATV 90 needs a guide surface, such as first edge 70 or second edge 80, to steer GATV along a curved section of guideway 20, continuous guide 190 is provided in the gap between central trough portion 60 of first guideway section 30 and central trough portion 60 of second and third guideway portions.

Continuous guide 190 is pivotable about its pivotable second end 210 between the initial first position and the final second position. In the initial first position, illustrated in FIG. 1, first continuous sidewall 260 of continuous guide 190 is aligned with second edge 80 of central trough portion 60 of first guideway section 30 at first end 200 of continuous guide 190. Similarly, first continuous sidewall 260 of continuous guide 190 is aligned with second edge 80 of central trough portion 60 of second guideway section 40 at second end 210 of continuous guide 190. In this manner, steering caster 180 runs along first continuous sidewall 260. Because first continuous sidewall 260 illustrated in FIG. 1 is substantially linear, steering caster 180 will only contact first continuous sidewall 260 in case GATV 90 is urged off of the linear path of travel. Accordingly, continuous guideway 190 only maintains the travel path of GATV 90 in its initial direction of travel while it transitions between first guideway section 30 and second guideway section 40. Central trough portion 60 on second guideway section 40 may have an expanded entryway to engage steering caster 180 in case it strays too far off course during the transition between first guideway section 30 and second guideway section 40. Once GATV 90 transitions across the switch point, steering caster 180 enters central trough portion 60 on second guideway section 40 for continued guidance of GATV 90.

By pivoting continuous guide 190 about pivot point 290 from the initial first position to the final second position, as shown in FIG. 2, the path of travel along first continuous sidewall 260 of continuous guide 190 is aligned with second edge 80 of central trough portion 60 of first guideway section 30 at first end 200 of guideway 20 can be changed from first guideway section 30 to third guideway section 50. Continuous guide 190 is pivoted about pivot point 290 by pivoting first end 200 on rolling support member 350 until stop face 400 adjacent to first continuous sidewall 260 engages first continuous sidewall 260. In the final second position, second continuous sidewall 270 of continuous guide 190 is aligned with first edge 70 of central trough portion 60 of first guideway section 30 at first end 200 of continuous guide 190. Similarly, second continuous sidewall 270 of continuous guide 190 is aligned with first edge 70 of central trough portion 60 of third guideway section 50 at second end 210 of continuous guide 190. In this manner, steering caster 180 engages second continuous sidewall 270 to redirect the path of GATV 90 from first guideway section 30 to third guideway section 50. Because first continuous sidewall 260 illustrated in FIG. 1 is curvilinear, steering caster 180 will maintain contact with second continuous sidewall 270 throughout the path of travel from first guideway section 30 to third guideway section 50. Once GATV 90 transitions across the switch point, steering caster 180 enters central trough portion 60 on third guideway section 50 for continued guidance of GATV 90.

While the device and method of the present invention have been described with respect to preferred embodiments, various modifications and alterations may be made without departing from the spirit and scope of the present invention. Although a switch system for a GATV has been used by way of an example, switch system may be adapted for use with various other guided vehicles. The scope of the present invention is defined in the appended claims and equivalents thereto.

The invention claimed is:

1. A switch system for a guided automatic transit vehicle (GATV) running along a guideway comprising a flat running surface with a central trough portion having a first edge and a second edge, wherein the switch system is adapted for either maintaining a first path of travel of the GATV or for redirecting the first path of travel of the GATV, the switch system comprising:

a continuous guide having a first end and a pivotable second end opposite the first end, the continuous guide further comprising:

a first edge comprising a first edge profile;

a second edge comprising a second edge profile;

a first continuous sidewall along the first edge between the first and the second end of the continuous guide; and a second continuous sidewall along the second edge between the first and the second end of the continuous guide, a pivot point about the pivotable second end, the pivot point having a pivot axis transverse to the longitudinal axis of the continuous guide, wherein the switch system pivots about the pivot point from an initial first position and a final second position;

wherein the switch system at the initial first position when the first continuous sidewall is aligned with the second edge of the central trough portion allows the GATV to continue travel along the first path of travel via the first continuous sidewall;

wherein the switch system at the final second position when the second continuous sidewall is aligned with the first edge of the central trough portion allows the GATV to continue travel along a second path of travel via the second continuous sidewall; and wherein the central trough portion has a first width between the first edge and the second edge, the continuous guide has a second width at the first end between the first edge of the continuous guide and the second edge of the continuous guide, the second width being larger than the first width.

2. The switch system of claim 1, further comprising at least one rolling support member provided at the first end for selective pivotal movement of the continuous guide about the pivot point between the initial first position and the final second position.

3. The switch system of claim 1, further comprising a stop member for selectively limiting the pivotal movement of the continuous guide between the initial first position and the final second position.

4. The switch system of claim 1, wherein the first sidewall is linear and the second sidewall is curvilinear.

5. The switch system of claim 4, wherein the second sidewall has a curvature of constant radius.

6. The switch system of claim 4, wherein the second sidewall has a curvature of variable radius.

7. The switch system of claim 1, wherein the first and second sidewalls are curvilinear.

8. The switch system of claim 2, wherein at least one rolling support member is a caster wheel or a cylindrical roller.

9. The switch system of claim 1, wherein the pivot point includes a thrust bearing.

10. The switch system of claim 1, further comprising a power member for selective pivotal movement of the continuous guide between the initial first position and the final second position.

11. The switch system of claim 10, wherein the power member is a mechanical, electrical, hydraulic, pneumatic, or magnetic device.

12. The switch system of claim 1, further comprising a controller for controlling the selective pivotal movement of the continuous guide between the initial first position and the final second position.

13. A method of switching a travel path of a guided automatic transit vehicle (GATV), the method comprising the steps of:

providing a guideway having a flat running surface with a central trough portion having a first edge and a second edge, the central trough portion also having a first width between the first edge and the second edge;

providing a switch system on the guideway, the switch system comprising:

a continuous guide having a first end and a pivotable second end opposite the first end, the guide further comprising:

a first edge comprising a first edge profile;

a second edge comprising a second edge profile;

a first continuous sidewall along the first edge between the first and the second end of the continuous guide;

a second continuous sidewall along the second edge between the first and the second end of the continuous guide; and a second width at the first end of the continuous guide between the first edge of the continuous guide and the second edge of the continuous guide, the second width of the continuous guide being larger than the first width of the central trough portion;

a pivot point about the pivotable second end, the pivot point having a pivot axis transverse to the longitudinal axis of the continuous guide for pivoting the switch system between an initial first position and a final second position;

guiding the GATV on the guideway along a first path of travel; and selectively pivoting the switch system between the initial first position and the final second position, wherein the switch system at the initial first position when the first continuous sidewall is aligned with the second edge of the central trough portion maintains the GATV along the first path of travel via the first continuous sidewall; and wherein the switch system at the final second position when the second continuous sidewall is aligned with the first edge of the central trough portion redirects the GATV to travel along a second path of travel via the second continuous sidewall.

14. The method of switching a travel path of the GATV according to claim 13, further comprising the step of providing at least one rolling support member at the first end for selective pivotal movement of the continuous guide about the pivot point between the initial first position and the final second position.

15. The method of switching a travel path of the GATV according to claim 13, further comprising the step of providing a stop member for selectively limiting the pivotal movement of the continuous guide between the initial first position and the final second position.

16. The method of switching a travel path of the GATV according to claim 13, wherein the first sidewall is linear and the second sidewall is curvilinear.

17. The method of switching a travel path of the GATV according to claim 13, wherein the second sidewall has a curvature of constant radius.

18. The method of switching a travel path of the GATV according to claim 13, wherein the second sidewall has a curvature of variable radius.

19. The method of switching a travel path of the GATV according to claim 13, wherein the first and second sidewalls are curvilinear.

20. The method of switching a travel path of the GATV according to claim 14, wherein the at least one rolling support member is a caster wheel or a cylindrical roller.

21. The method of switching a travel path of the GATV according to claim 13, wherein the pivot point includes a thrust bearing.

22. The method of switching a travel path of the GATV according to claim 13, farther comprising a power member for selective pivotal movement of the continuous guide between the initial first position and the final second position.

23. The method of switching a travel path of the GATV according to claim 22, wherein the power member is a mechanical, electrical, hydraulic, pneumatic, or magnetic device.

24. The method of switching a travel path of the GATV according to claim 13, further comprising the step of providing a controller for controlling the selective pivotal movement of the continuous guide between the initial first position and the final second position.

* * * * *